US006718882B1

(12) United States Patent
Sheng

(10) Patent No.: US 6,718,882 B1
(45) Date of Patent: Apr. 13, 2004

(54) TWO-WAY-BURNING SPARKLER AND METHOD OF MANUFACTURE

(75) Inventor: Qui Fu Sheng, Hunan (CN)

(73) Assignee: Hunter Pacific Limited, Tortola (VG)

( * ) Notice: Subject to any disclaimer, the term of this patent is extended or adjusted under 35 U.S.C. 154(b) by 0 days.

(21) Appl. No.: 10/284,902

(22) Filed: Oct. 31, 2002

(51) Int. Cl.[7] ..... F42B 4/00
(52) U.S. Cl. ..... 102/335
(58) Field of Search ..... 102/335, 336; 86/1.1

(56) References Cited

U.S. PATENT DOCUMENTS 1,174,321 A * 3/1916 Jedel ..... 102/335
1,709,033 A * 4/1929 Miller ..... 149/15
1,936,221 A * 11/1933 Adler ..... 102/335
3,862,865 A * 1/1975 McManus et al. ..... 149/19.91

* cited by examiner

*Primary Examiner*—Michael J. Carone
*Assistant Examiner*—Aileen B. Felton
(74) *Attorney, Agent, or Firm*—E. Alan Uebler, PA

(57) ABSTRACT

A sparkler for use as a fireworks display is provided. The sparkler has an extended spark display time, burning and emitting sparks in one direction initially followed by the spark progression reversing direction and then burning while emitting sparks in the reverse direction. The sparkler construction provides inner and outer sheaths of a flammable spark composition separated by an insulating layer of a fire resistant material. The inner and outer layers are in contact with one another at one end of the sheath, to permit ignition of the inner flammable composition by the progressing spark. Especially preferred is a construction of the aforesaid sparkler which emits sparks of one color upon the initial burn and sparks of a different color upon the reverse burn. Also provided is a process for the manufacture of these novel sparklers.

13 Claims, 2 Drawing Sheets

TWO-WAY-BURNING SPARKLER AND METHOD OF MANUFACTURE

BACKGROUND OF THE INVENTION

The present invention relates to hand-holdable pyrotechnic devices commonly referred to as "sparklers", and to a method of manufacture of sparklers.

Fireworks are often on display on festive occasions. Among prominent displays is the $4^{th}$ of July holiday in the U.S., and fireworks displays are often part of celebrations at other times and worldwide, such as at the New Year holiday each year, at Halloween, and at various sporting events. One fireworks product often seen at such displays is the hand-held sparkler.

A sparkler is a device that emits brilliant sparks upon burning. Conventional sparklers generally are made of a long, thin stick or metal wire having a flammable, spark-emitting coating, e.g., a phosphorous compound, thereon. When the coated end of the sparkler remote from the hand hold is ignited, e.g., with a match, lighter, punk, etc., the coating ignites, sparks are randomly emitted as the ignition point travels down the wire, usually for a few minutes, and the spark burns out when it reaches the end of the coating and before contacting the hand of the user. Many holiday revelers are attracted to and enjoy using and/or viewing sparklers, which devices have been known, generally, for centuries.

The present invention provides a new form of sparkler and a method for its manufacture. This new sparkler has an extended burning time, and thus a concomitant extended time for enjoyment, over conventional sparklers of the same length. Also, in one embodiment of the invention, the sparkler burns for a time emitting sparks of one color, and the direction of burning of the spark reverses itself and then burns for a time emitting sparks of a color different from that of the initial burn. The need and desirability of the novel sparklers of this invention are readily apparent.

SUMMARY OF THE INVENTION

An article of manufacture suitable for use in a sparkler fireworks display is provided. The sparkler of this invention includes an elongate central core having a first coating thereon of an ignitable, flammable, spark-emitting-upon-ignition material. This first coating extends along the length of the core a first distance from one end thereof, the distal end, leaving a portion of the core bare at the proximate end thereof opposite the one end, the bare portion acting as a hand-hold thereof. The core and first coating have a second coating thereon extending along the outside of the first coating from and including the one end, along the length thereof extending a second distance from the one end, this second coating being of a fire resistant material. The core, first coating and second coating have a third coating thereon, wherein the third coating is of an ignitable, flammable, spark-emitting-upon-ignition material. The third coating extends as a sheath along the outside of and along the length of the core and first and second coatings to a third distance from and including the distal end. The first and third distances both exceed the second distance. Optionally, and optimally, the third distance of coating coverage exceeds the first distance of coating coverage.

The central core may be a wire, preferably an iron wire, or it may be a stick, such as a wooden stick. The bare portion of the core is sufficiently long to enable hand holding of the sparkler. The core may have a length of approximately one foot or, alternatively, the core may have a length which exceeds one foot.

The first ignitable coating material is one which produces a selected one of the spark colors of red, green, yellow, silver or gold, upon ignition, and the third coating is of a material which produces a selected one of the spark colors of red, green, yellow, silver or gold, upon ignition. The first ignitable coating material and the third coating material may be selected such that two different-colored sparks are produced by the materials upon ignition. In a preferred embodiment, the first ignitable coating material is one which emits gold sparks upon ignition and the third coating material is selected such that sparks are produced upon ignition thereof of a selected one of the colors red, green, yellow and silver.

A process for making sparklers is also provided. The process includes securing a plurality of elongate cores in a holder therefore, each core being releasably held in the holder proximate one end of the core. Each core extends essentially vertically downwardly from the holder such that a substantial length of all of the cores extends, exposed, downwardly and outwardly from the holder. The holder and secured elongate cores are dipped into a first dip tank containing a coating composition of a material which, after coating and drying, is ignitable, flammable and spark-emitting, and the holder and secured coated cores are withdrawn and dried. Optionally, the dipping into this first dip tank, withdrawing and drying, are repeated, as desired, to increase the amount of coating applied to each core. The coated cores are then dipped into a second dip tank containing a coating composition of a fire resistant material, this dipping being to a lesser depth within the coating composition than in the first dipping. The coated cores are withdrawn and dried, followed by dipping of the holder and secured, coated cores into a dip tank containing a coating composition of a material which, after coating and drying, is ignitable, flammable and spark-emitting. This dipping step subjects the cores to a greater dipped depth within this composition than in the previous dipping into the fire resistant composition. The holder and secured coated cores are withdrawn and dried. Optionally, this dipping, withdrawing and drying is repeated, as desired.

The plurality of dipped, coated and dried cores are released from the holder, thereby producing a plurality of fireworks display articles, namely a plurality of sparklers.

Any one of the flammable, spark emitting coating compositions may comprise a slurry of potassium perchlorate, magnesium aluminum alloy, strontium carbonate, a binder resin and ethanol, to produce red sparks on ignition. Alternatively, the coating composition may be a slurry of potassium perchlorate, barium nitrate, magnesium aluminum alloy, a binder resin and ethanol (green sparks), a slurry of barium nitrate, magnesium aluminum alloy, potassium perchlorate, Cryolite, sulfur and water (yellow sparks), or potassium perchlorate, barium nitrate, magnesium aluminum alloy, sulfur and water (silver sparks) or barium nitrate, iron, aluminum, phenolic resin and water (gold sparks).

The fire resistant coating composition preferably comprises a solution of a phenolic resin, pentaerythritol and triammonium phosphate, most preferably 35% phenolic resin, 50% pentaerythritol and 15% triammonium phosphate.

The drying may be air drying, oven drying or any other suitable drying method.

DETAILED DESCRIPTION OF THE INVENTION AND PREFERRED EMBODIMENTS WITH REFERENCE TO THE DRAWINGS

A sparkler for use as a fireworks display is provided. The sparkler has an extended spark display time, burning while emitting sparks in one direction initially, followed by the spark progression reversing direction and then burning while emitting sparks in the reverse direction. The sparkler construction provides inner and outer sheaths of a flammable spark composition separated by an insulating layer of a fire resistant material. The inner and outer layers are in contact with one another at one end of the sheathes, to permit ignition of the inner flammable composition by the progressing spark. Especially preferred is a construction of the aforesaid sparkler which emits sparks of one color upon the initial burn and sparks of a different color upon the reverse burn. Also provided is a process for the manufacture of these novel sparklers.

Figure 1:
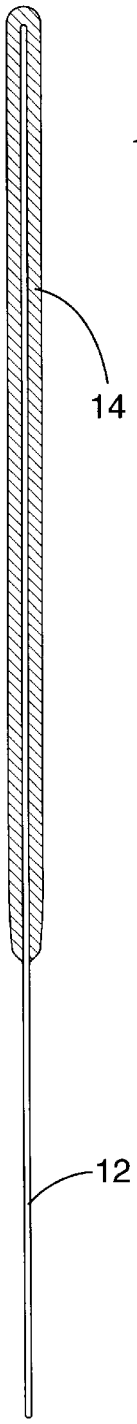
FIG. 1 is a side elevation, partly in cross-section, of a precursor component to the sparkler of the invention, similar in many respects to a conventional sparkler.

A detailed description of the invention and its preferred embodiments is best provided with reference to the accompanying drawings, wherein FIG. 1 illustrates a wire, 12, preferably an iron wire, having a coating 14 deposited thereon along a portion of the length of the wire 12. That portion of the wire 12 left uncoated is the holding portion of the complete sparkler. The coating composition 14 is flammable and one which emits brilliant sparks upon ignition. Coating compositions and a method of manufacture of the sparklers are described in detail below.

Figure 2:
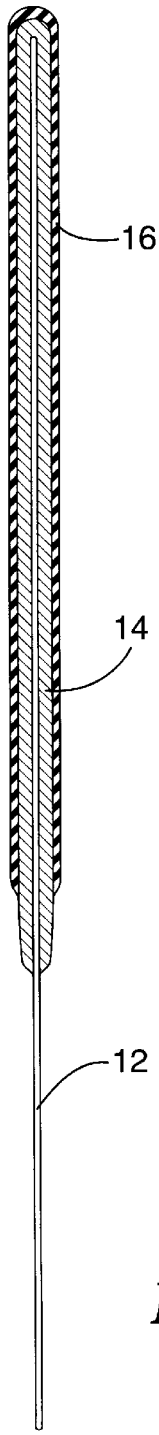
FIG. 2 is a side elevation, partly in cross-section, of an intermediate component in the preparation of the sparkler of the invention, showing a fire-resistant coating thereon.

In FIG. 2, an additional coating layer 16 has been applied to the invention precursor construction of FIG. 1. The coating layer 16 is of a fire resistant composition such as, for example, a composition including a phenol-formaldehyde resin and triammonium phosphate.

Figure 3:
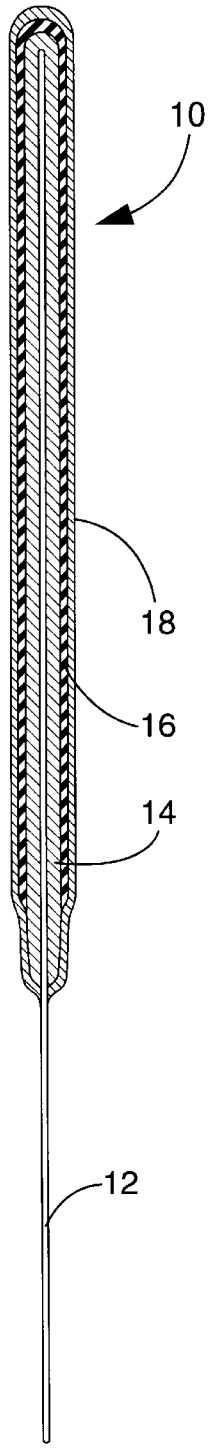
FIG. 3 is a side elevation, partly in cross-section, of the sparkler according to the invention.

FIG. 3 depicts the construction of FIG. 2 having an additional coating 18 deposited thereon, extending from the distal end of core wire 12, and covering the fire resistant coating 16 and extending along its length and beyond, to completely cover the first coating 14, as well as the fire resistant coating 16. The third coating 18 is also of a composition which is ignitable and flammable and which emits brilliant sparks upon ignition.

The relative lengths of the coatings 14, 16 and 18 along the core 12 of the sparkler of the invention are critical. To function properly after ignition at the distal end of the sparkler 10, the fire resistant coating must extend to a lesser distance along the core wire 12 than does the inner, spark-emitting coating 14, as depicted in FIGS. 2 and 3. The outer, spark-emitting coating 18 must extend over the entire length of the fire-resistant coating 16 and come into contact at the proximal (hand-holding)end thereof with the inner spark-emitting coating 14. The sequence of ignition and burning is illustrated in greater detail in the next sequence of figures.

Figure 4:
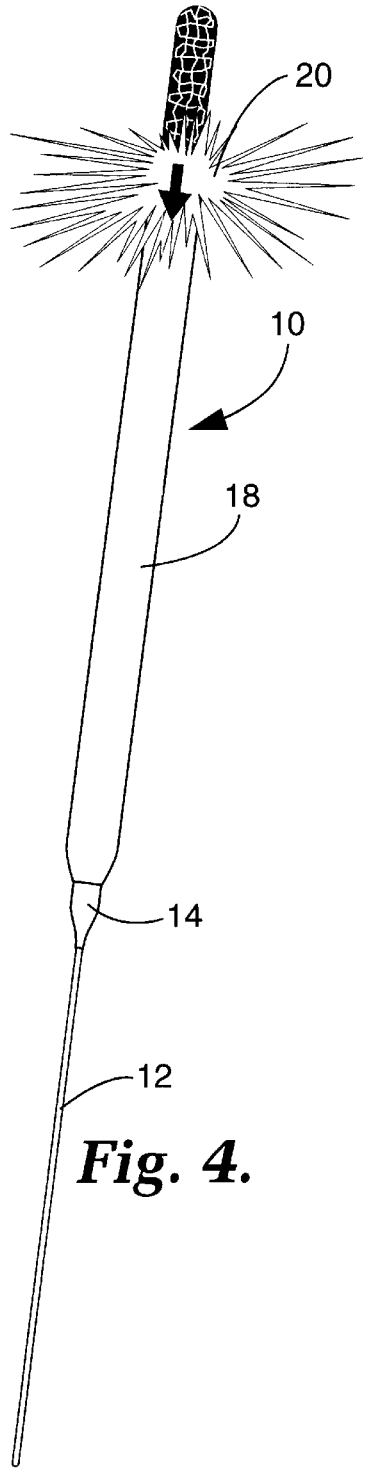
FIG. 4 is a schematic illustration of the sparkler of the invention shortly after ignition, showing the spark progressing downwardly along the holding wire.
Figure 5:
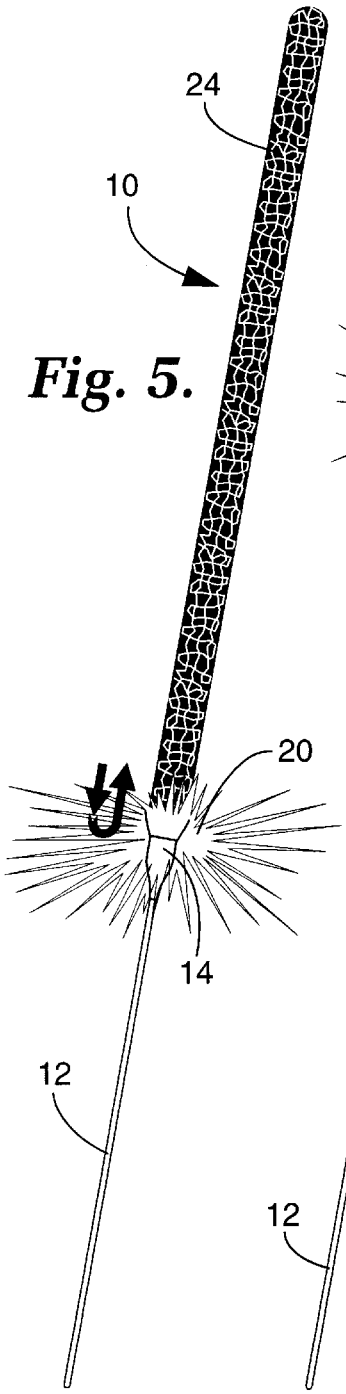
FIG. 5 is a schematic illustration of the sparkler of the invention wherein the spark has progressed to near its lowermost burning location, just prior to reversing direction and beginning its upward, reverse burn.
Figure 6:
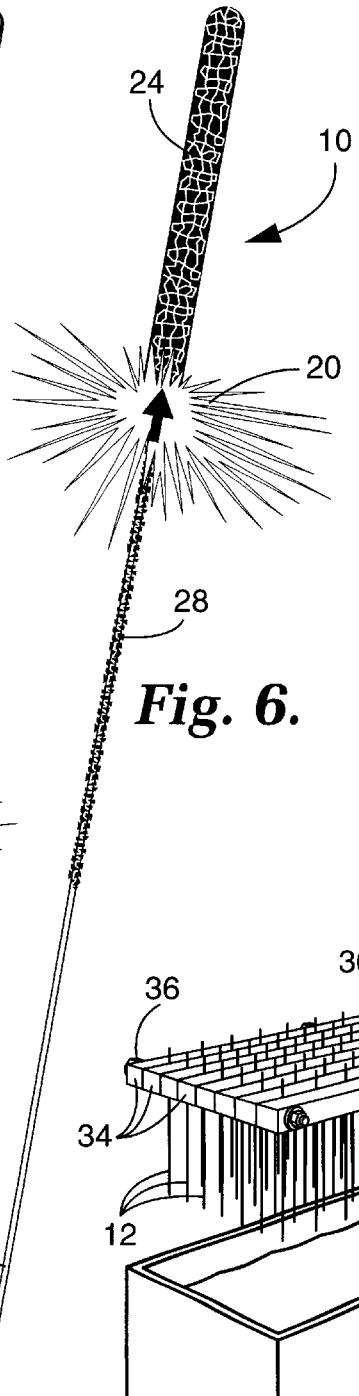
FIG. 6 depicts, schematically, the spark of the sparkler of the invention progressing back upwardly along the holding wire to the point of ignition.

In FIG. 4, the distal end of the sparkler 10 has been ignited, and the spark 20 is traveling along the sparkler 10 in the direction indicated by the bold arrow, advanced by the burning of composition 18. When the spark advances downwardly to the point of exhaustion of composition 18, leaving behind the ash, 24, of composition 18, as depicted in FIG. 5, it reverses in direction, indicated by the curved arrows, owing to the ignition of the inner composition 14 thereat, which ignition has previously been prevented by the overlay of the fire-resistant material 16 thereon. From this point, the spark 20 reverses in direction and proceeds upwardly along the sparkler 10 back to the distal end thereof, the ash 24 of the outer flammable composition 18 being shed during this process, leaving behind the ash, 28, of composition 14, all as shown in FIG. 6.

In this way, the burn time of any given sparkler is extended over that of conventional sparklers, essentially doubled, in the construction of the invention. In addition, multiple color effects are possible by using two different colored spark-emitting pyrotechnic compositions for the layers 14 and 18.

Figure 7:
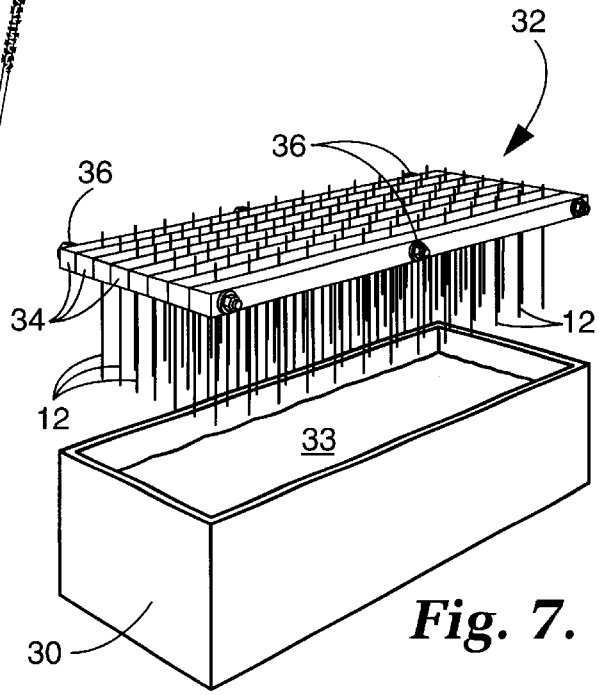
FIG. 7 shows, schematically, the apparatus used in the manufacture of the sparklers of the invention.

A process for making the sparklers 10 of the invention is illustrated schematically in FIG. 7. In general, iron wires are preferably used as the cores 12 of the sparklers 10 to be manufactured in quantity. The iron wires are first straightened if necessary. A plurality of wires 12 is mounted in a rack 32, which may be constructed of multiple wooden slats 34 which are bolted together by bolts 36. In the figure, eight slats 34 and three bolts 36 are shown, but these specific components can vary, as will be clear to one skilled in the art.

Dip tanks 30 are prepared. Only one tank 30 is shown, but at least two and preferably three tanks are employed. Into the first tank is placed a slurry of the sparkler mix. Coatings 14 on the wires 12 are applied by dipping the wires 12 into the slurry mix 33 and allowing the slurry to coat the wires. The rack 32 is withdrawn with the slurry mix adhered to the wires 12 and then the rack is placed in a drying room for drying. After drying, a second dipping of these same wires can be undertaken as before, and this increases the thickness of the sparkler slurry mix coating on the wires.

When the powder coated wires 12 are completely dried, while still in rack or frame 32, they are dipped into a second tank 30 containing a fire resistant solution. The wires are dipped therein, but to a depth so as to leave a portion of the first coating 14 (FIG. 2) of each wire 12, at the proximal end thereof, uncoated by the fire resistant material. Preferably, this distance of non-coating of fire resistant material is about 0.5 cm, but this can vary as will be apparent to those skilled in the art. At this stage of production, the components have the construction depicted in FIG. 2, that is, a core wire 12 having a first flammable spark coat 14 and a coating of fire resistant material 16 as shown, leaving the proximal end of coating 14 uncoated by the material 16 as shown.

After drying, these coated sparkler components are again dipped into a tank 30 containing a flammable sparkler mix as before. This sparkler mix can be the same mix as in the first dipping, but preferably this mix is one which produces a different color of sparks than that produced by the first dip mix. The sparkler components are dipped into the mix to a depth such that, preferably, both previous coating layers are fully coated. This dipping is followed by withdrawing the rack 32 and drying as before, and multiple dippings can be undertaken to increase the thickness of the coatings on the wires, also as before.

After drying, the sparklers 10 have the finished configuration shown in cross-section in FIG. 3, and schematically in FIG. 4, the latter having been ignited to produce sparks emitted from the ignition point 20. The finished sparklers are removed from the racks 32 after drying, and at that point in the production they are ready for packaging, shipping and marketing.

One particular size of sparkler to be produced has a total length of 248 mm, with an outside diameter of coating of (approx.) 6 mm, and weighs a total of 6.4 gm. The handle portion (bare wire) is 110 mm in length and 1.2 mm in diameter, with the powder coating length being 138 mm. The total powder coating weight is 4.2 gm. This specific example is provided for illustration only, and is not intended to be limiting of the invention in any manner.

In the preparation of the sparkler powder coating mixtures to be placed into the dip tanks 30, the powder and binder are first prepared to a paste consistency, and this mixture is poured into the dip tank 30. Various formulations are used to prepare coatings which emit different colored sparks on ignition. Representative examples of these formulations are presented in Table 1. As used herein, all percentages are by weight, based upon the total composition weight, unless otherwise stated.

A fire resistant coating can be prepared from various components, as will be known to one skilled in this art. A representative example of one such coating is prepared as a solution of 35% Resinox® phenol-formaldehyde resin (available from Xin Da Shuzuhi Factory, Yang Jia Long, He Hua, Liuyang, Hunan, China), 15% triammonium phosphate and 50% pentaerythritol.

Coating the wires as described above to produce sparklers may be employed to create heretofore unavailable spark displays of varying colors. For example, if the first coating 14 is of a powder which produces gold sparks and the outer coating 18 is of a material which produces red sparks, upon ignition at the distal end of sparkler 10, shown in FIG. 4, the spark descends along the wire emitting red sparks until, as shown in FIG. 5, the inner, gold coating is ignited, the spark reverses itself, and proceeds upwardly as depicted in FIG. 6 emitting gold sparks.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

TABLE 1

| Spark Composition | Carrier |
|---|---|
| Red Sparks: | |
| Potassium Perchlorate: 45%<br>50/50 Mg + Al Alloy powder, 120 mesh: 16%<br>Strontium Carbonate: 25%<br>Phenol-formaldehyde Resin: 6% | Ethanol<br>(diluted to paste-like consistency), 8% |
| Green Sparks: | |
| Potassium Perchlorate: 20%<br>Barium Nitrate: 50%<br>Mg + Al Alloy: 15%<br>Phenol-formaldehyde Resin: 7% | Ethanol<br>(diluted to paste-like consistency), 8% |

TABLE 1-continued

| Spark Composition | Carrier |
|---|---|
| Yellow Sparks: | |
| Barium Nitrate: 55%<br>50/50 Mg + Al Alloy powder, 120 mesh: 15%<br>Potassium Perchlorate: 1O%<br>Cryolite ($NaAlF_6$)powder, 120 mesh: 9%<br>Sulfur: 11% | Water*<br>(diluted to paste-like consistency) |
| Silver Sparks: | |
| Potassium Perchlorate: 10%<br>Barium Nitrate: 55%<br>Sulfur: 20%<br>50/50 Mg + Al Alloy powder, 120 mesh: 15% | Water*<br>(diltited to paste-like consistency) |
| Gold Sparks | Water* |
| Barium Nitrate: 55%<br>Iron powder, 120 mesh: 28%<br>Aluminum powder, 200 mesh: 10%<br>Phenol-formaldehyde Resin: 7% | (diluted to paste-like consistency) |

*The water carrier is typically mixed in a ratio of 1 part to 3 parts of spark composition to achieve a desired consistency, and, optionally, flour may be added to the water carrier, in a ratio of 1 part flour to 11 parts water.

What is claimed is:

1. A fireworks display article of manufacture, being a sparkler, said article comprising:

an elongate central core having a first coating thereon of an ignitable, flammable, spark-emitting-upon-ignition material, said first coating extending along the length of said core a first distance from one end thereof, leaving a portion of said core bare at the end thereof opposite said one end, said core and first coating having a second coating thereon extending along the outside of said first coating from and including said one end, along the length thereof a second distance from said one end, said second coating being of a fire resistant material, said core, first coating and second coating having a third coating thereon, said third coating being of an ignitable, flammable, spark-emitting-upon-ignition material, said third coating extending along the outside of and along the length of said core and first and second coatings to a third distance from and including said one end, wherein, said first and third distances both exceed said second distance.

2. The sparkler of claim 1 wherein said central core is a wire.

3. The sparkler of claim 2 wherein said wire is an iron wire.

4. The sparkler of claim 1 wherein said core is a stick.

5. The sparkler of claim 4 wherein said stick is a wooden stick.

6. The sparkler of claim 1 wherein said bare portion of said core is sufficiently long to enable hand holding of said sparkler.

7. The sparkler of claim 1 wherein said core has a length of approximately one foot.

8. The sparkler of claim 1 wherein said core has a length which exceeds one foot.

9. The sparkler of claim 1 wherein said first ignitable coating material is one which produces a selected one of the spark colors of red, green, yellow, silver or gold, upon ignition.

10. The sparkler of claim 1 wherein said third coating is of a material which produces a selected one of the spark colors of red, green, yellow, silver or gold, upon ignition.

11. The sparkler of claim 1 wherein said first ignitable coating material and said third coating material are selected such that two different-colored sparks are produced by said materials upon ignition.

12. The sparkler of claim 11 wherein said first ignitable coating material is one which emits gold sparks upon ignition and said third coating material is selected such that sparks are produced upon ignition thereof of a selected one of the colors red, green, yellow and silver.

13. The article of manufacture of claim 1 wherein said coating of fire resistant material is of, a material comprising a fire resistant phenolic resin and triammonium phosphate.

* * * * *